US007325532B2

(12) United States Patent
Dölker

(10) Patent No.: US 7,325,532 B2
(45) Date of Patent: Feb. 5, 2008

(54) METHOD FOR THE TORQUE-ORIENTED CONTROL OF AN INTERNAL COMBUSTION ENGINE

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/639,694

(22) Filed: Dec. 15, 2006

(65) Prior Publication Data

US 2007/0142997 A1 Jun. 21, 2007

(30) Foreign Application Priority Data

Dec. 17, 2005 (DE) ..... 10 2005 060 540

(51) Int. Cl.
*F02D 41/00* (2006.01)
*F02D 31/00* (2006.01)

(52) U.S. Cl. ..... 123/350; 123/357

(58) Field of Classification Search ..... 123/350, 123/352, 357, 361, 399, 435, 478, 480, 488, 123/406.23; 701/102, 103, 110
See application file for complete search history.

(56) References Cited

U.S. PATENT DOCUMENTS 4,428,341 A 1/1984 Hassler et al.
4,926,826 A * 5/1990 Nakaniwa et al. ..... 123/696
6,171,212 B1 * 1/2001 Reuschel ..... 477/86
6,260,524 B1 * 7/2001 Wachi ..... 123/90.15
6,394,930 B1 * 5/2002 Reuschel ..... 477/83
6,505,594 B1 * 1/2003 Katayama et al. ..... 123/179.18
6,659,079 B2 * 12/2003 Price ..... 123/339.21
6,807,939 B1 10/2004 Dolker
6,941,930 B2 * 9/2005 Uhl ..... 123/406.23
2006/0118083 A1 6/2006 Dolker et al.

FOREIGN PATENT DOCUMENTS

DE 30 23 350 1/1982
DE 199 53 767 5/2001
DE 103 02 263 3/2004
DE 10 2004 001 913 8/2005

* cited by examiner

*Primary Examiner*—John T. Kwon
(74) *Attorney, Agent, or Firm*—Klaus P. Stoffel; Wolff & Samson PC

(57) ABSTRACT

A method for the torque-oriented control of an internal combustion engine, in which a sum torque (MSUM) is calculated from a set torque value (MSW) and a friction torque (MF). A set injection quantity (mSL) for driving the internal combustion engine is calculated from the sum torque (MSUM) and an actual rpm value (nIST) by the use of an efficiency map (WKF). The set torque value (MSW) is calculated by way of an rpm controller with at least PI behavior from an rpm control deviation (e) between the set rpm value (nSL) and the actual rpm value (nIST), and the I component of the rpm controller is limited to a lower limit value (uGW), which is determined as a function of the friction torque (MF) (uGW=f(MF)).

12 Claims, 5 Drawing Sheets

RKF

| TVIRT [Degree C] \ nIST [1/min] | 0 | 600 | 800 | 1000 | 1200 | 1400 | 1600 | 1800 | 2000 | 2100 |
|---|---|---|---|---|---|---|---|---|---|---|
| 100 | 0 | 340 | 340 | 341 | | | 343 | 344 | 345 | 346 |
| 90 | 0 | 345 | 346 | | | | | 349 | 350 | 351 |
| 70 | 0 | 350 | | | | | | 356 | 356 | 356 |
| 50 | 0 | | | | | | | | 360 | 361 |
| 35 | 0 | | | | | | | | | 366 |
| 20 | 0 | | | | | | | | | |
| 10 | 0 | | | | | | | | | |
| 0 | 0 | 380 | | | | | | | | |
| -10 | 0 | 390 | 390 | | | | | | | |
| -20 | 0 | 400 | 410 | 420 | | | | | | MAX |

MF [Nm]

WKF

| MSUM [Nm] | 0 | 600 | 800 | 1000 | 1200 | 1400 | 1600 | 1800 | 2000 | 2100 |
|---|---|---|---|---|---|---|---|---|---|---|
| 4000 | 0 | 270 | 271 | 273 | | | | 279 | 280 | 283 |
| 3500 | 0 | 230 | 231 | | | | | | 239 | 240 |
| 3000 | 0 | 210 | 211 | | | | | | 217 | 219 |
| 2500 | 0 | 180 | | | | | | | | 190 |
| 2000 | 0 | 130 | | | | | | | | 141 |
| 1500 | 0 | | | | | | | | | |
| 1000 | 0 | 55 | | | | | | | | 68 |
| 500 | 0 | 21 | 21 | | | | | | 27 | 30 |
| 0 | 0 | 10 | 12 | 13 | | | | 16 | 18 | 18 |
| -100 | 0 | 0 | 0 | 0 | 0 | 0 | 0 | 0 | 0 | 0 |

mSL [mg/stroke]

nIST [1/min]

Fig. 4

METHOD FOR THE TORQUE-ORIENTED CONTROL OF AN INTERNAL COMBUSTION ENGINE

BACKGROUND OF THE INVENTION

The invention pertains to a method for the torque-oriented control of an internal combustion engine, in which a sum torque is calculated from a set torque value and a friction torque, and in which a set injection quantity for controlling the internal combustion engine is calculated from the sum torque and an actual rpm value on the basis of an efficiency map.

A similar method is known from DE 10 2004 001 913 A1. In this method, the set torque value is determined from an input variable representing the desired power output. In the case of a motor vehicle application, this input variable corresponds to the position of a gas pedal, to which the set torque value is assigned by way of a characteristic curve. In the case of a generator application, the desired power output corresponds to a set rpm value, such as 1,500 rpm in the case of a 50-Hz generator application. In the case of a ship application, the input variable corresponds to the position of a selector lever selected by the operator. In the case of generator or ship applications, the rpm value of the internal combustion engine is regulated automatically. For this purpose, a control deviation between the set rpm and the actual rpm value is calculated, and the set torque value is determined as an actuating variable by way of an rpm controller.

Abrupt load changes at the power takeoff of the internal combustion engine are difficult to deal with. For example, the actual rpm's increase significantly when a ship's drive rises out of the water. When the drive becomes immersed again, the reverse phenomenon occurs; that is, the actual rpm's drop to a value considerably below the set rpm value. When the actual rpm value exceeds a certain limit, an "emergency stop" can be triggered. Known measures for improving this situation include changing the time at which injection begins and introducing an additional torque-limiting controller. Under normal operating conditions, this controller limits the actuating variable of the rpm controller and does not become dominant again until after the ship's drive is immersed again. A similar control circuit design and a similar method are described in DE 199 53 767 A1. No additional measure is provided to deal with load shedding.

SUMMARY OF THE INVENTION

The invention is based on the task of providing a further improvement to the operational reliability of an internal combustion engine with torque-oriented open-loop and closed-loop control, especially the reliability during load shedding.

In one embodiment, the I component (integrating component) of the rpm controller is limited to a lower limit value. The lower limit value in this case is calculated as a function of a friction torque. As an alternative, the lower limit value can be set at a constant value, which is determined definitively by a maximum friction torque from a friction torque map. Another measure for increasing the operational reliability consists in limiting the set torque value, that is, the actuating variable calculated by the rpm controller, to the lower limit value.

The friction torque is calculated by way of the friction torque map as a function of a virtual temperature and the actual rpm value. Instead of an absolute friction torque, it is also possible to use a relative friction torque to set the limit.

The relative friction torque describes the deviation between the actual state of the internal combustion engine and the standard state. In the standard state, the relative friction torque is zero. The absolute and the relative friction torques are readjusted as a function of the input variables. The friction torque map can contain total values or individual values for each cylinder. In the case of individual cylinder values, the starting value of the friction torque map must be multiplied by the number of cylinders.

When load shedding occurs, the correction time is reduced by the invention, and the increase in the actual rpm's is reduced, as a result of which, in the case of a generator application, it is ensured that the legal standards (DIN) are reliably fulfilled. In very general terms, the invention offers the advantage that the safety-critical limit values for an emergency stop can be set much more generously.

Other features and advantages of the present invention will become apparent from the following description of the invention that refers to the accompanying drawings.

BRIEF DESCRIPTION OF THE DRAWINGS

An exemplary embodiment of the invention is explained below on the basis of the drawings:

FIG. 4 shows an efficiency map;

DETAILED DESCRIPTION OF THE INVENTION

Figure 1:
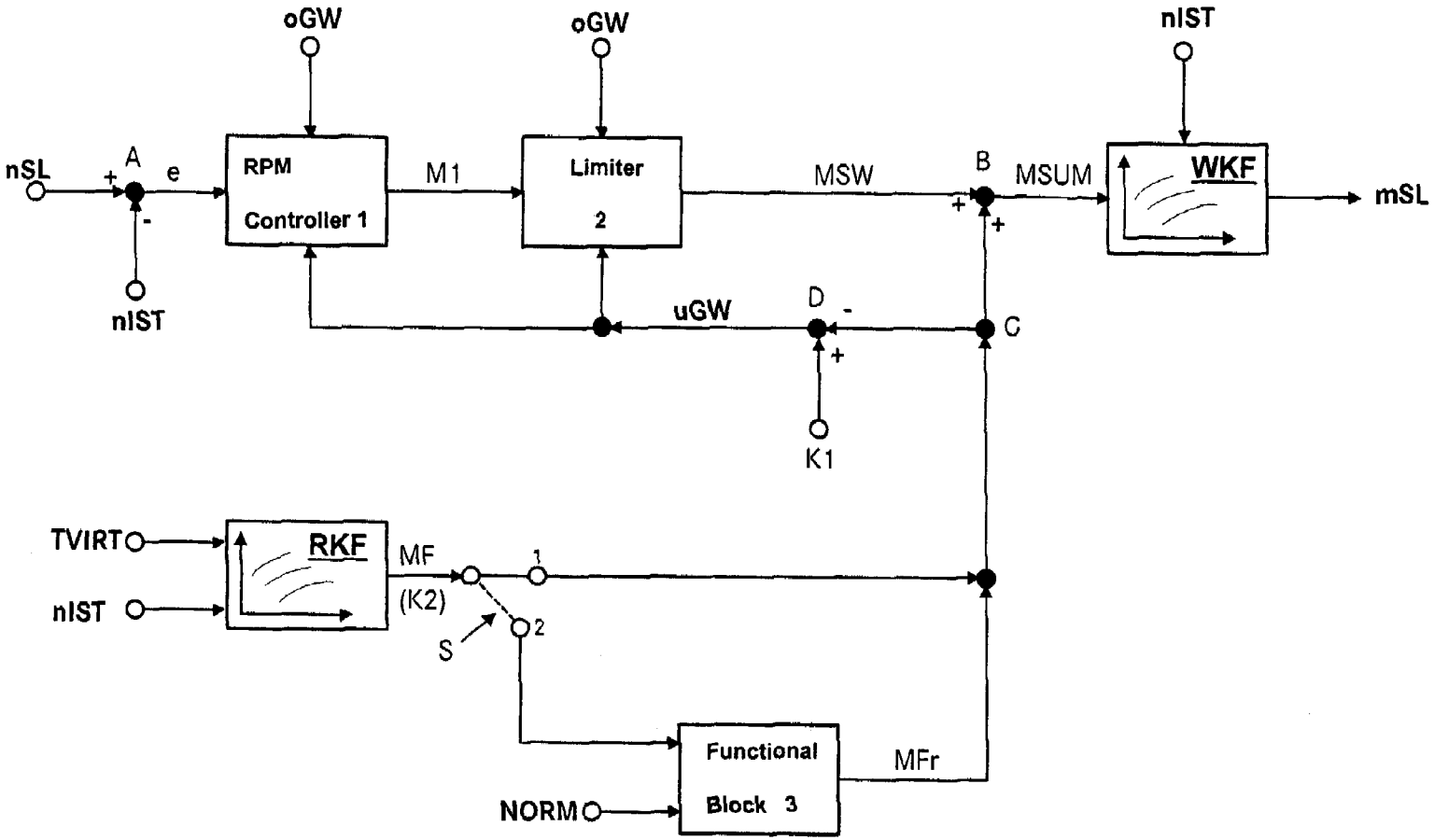
FIG. 1 shows a functional block diagram of the method used to calculate the set injection quantity.

FIG. 1 shows a functional block diagram of the method used to calculate a set injection quantity. The input variables are: a set rpm value nSL, an actual rpm value nIST, a virtual temperature TVIRT, an upper limit value oGW, a first constant K1, and a signal NORM, which stands for a defined operating state of the internal combustion engine. The output variable corresponds to the set injection quantity mSL with which, for example, the injector in a common rail system is supplied. Of course, the output variable can also correspond to a set injection mass. The virtual temperature TVIRT is calculated from two measured temperatures such as a coolant temperature and an oil temperature by the use of a mathematical function. A suitable function is known from DE 10 2004 001 913 A1.

The deviation between the set rpm value nSL and the actual rpm value nIST (summation point A) corresponds to a control deviation "e". On the basis of the control deviation e, an rpm controller 1 determines a torque M1 as the actuating variable. The rpm controller 1 has at least one PI (proportional-integral) behavior. The torque M1 is limited by a limiter 2. The output variable of the limiter 2 corresponds to the set torque value MSW. At a summation point B, the set torque value MSW and a friction torque MF or a relative friction torque MFr are added together. The result of the addition at point B corresponds to a sum torque MSUM. By the use of an efficiency map WKF, the set injection quantity mSL is calculated from the sum torque MSUM and the actual rpm value nIST. The efficiency map WKF is shown in FIG. 4 and is described in connection with the explanation of that figure.

Figures 2, 3:
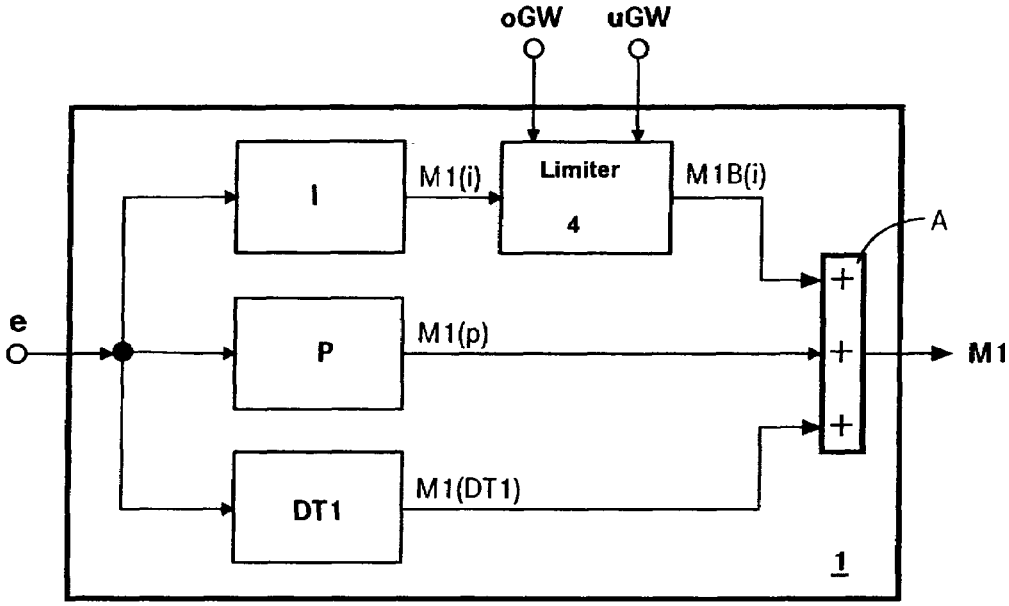
FIG. 2 shows the internal structure of the rpm controller.
FIG. 3 shows a friction torque map.

FIG. 1 shows a switch S. In switch position 1, the second summand at summation point B corresponds to the friction torque MF. The friction torque MF is calculated from the virtual temperature TVIRT and the actual rpm value $n_{IST}$ by the use of a friction torque map RKF. The friction torque map RKF is shown in FIG. 3 and will be described in conjunction with the explanation of that figure. In switch position 2, the friction torque MF is compared with a standard friction torque NORM by way of a functional block 3. The output variable of this comparison corresponds to the relative friction torque MFr. The standard friction torque NORM is determined by the manufacturer of the internal combustion engine by means of test bench experiments under standardized conditions. The standardized conditions for a warmed-up internal combustion engine are characterized, for example, by an ambient air pressure of 1,013 hectopascals and a constant fuel temperature of 25° C. When the internal combustion engine is in the standard state, the relative friction torque MFr is zero.

The invention now provides that, during load shedding, for example, the I component of the rpm controller 1 is limited to a lower limit value uGW. Supplementally, the actuating variable of the rpm controller 1, that is, the torque M1, can also be limited by the limiter 2 to the lower limit value uGW. The lower limit value uGW is calculated as a function of the negative friction torque MF (S=1) or the negative relative friction torque MFr (S=2), in that this torque is added to the first constant K1 at summation point D. In practice, the first constant K1 corresponds to, for example, a value of −100 Nm. Instead of calculating the friction torque MF or the relative friction torque MFr, these can be set to the value of a second constant K2; for this purpose, see the value MAX in FIG. 3. As a result, the continued operation of the internal combustion engine is ensured even in the event of a sensor failure. To limit the I component of the rpm controller 1 and the actuating variable M1, a corresponding signal path from point D to the rpm controller 1 and to the limiter 2 is shown in FIG. 1.

FIG. 2 shows the internal structure of the rpm controller 1. The input variables are the control deviation e, the upper limit value oGW, and the lower limit value uGW. The output variable corresponds to the torque M1. The rpm controller 1 comprises a P component for calculating a proportional torque M1(p) from the control deviation e; an I component for calculating an integrating torque M1(i) from the control deviation e; and a DT1 component for calculating a DT1 torque M1(DT1) from the control deviation e. The I component of the rpm controller 1, that is, the integrating torque M1(i), is limited to the upper limit value oGW and, according to the invention, to the lower limit value uGW. For this purpose, a limiter 4 is installed downline from the I component in the signal path. The output signal of the limiter 4 corresponds to a torque M1B(i). At a summation point A, the individual signal components M1(p), M1B(i), and M1(DT1) are added together. The result corresponds to the output signal M1.

FIG. 3 shows the friction torque map RKF in the form of a table. The values of the actual rpm value nIST are plotted on the x axis in 1/min. The virtual temperature TVIRT is plotted on the y axis in degrees centigrade. The values within the table correspond to z values, that is, to the friction torque MF in newton-meters. For example, an absolute friction torque MF of 349 Nm is correlated with the value pair nIST=1,800 1/min and TVIRT=90° C. In the friction torque map RKF, a value MAX, which represents the maximum friction torque, is assigned to the lowest possible virtual temperature TVIRT and the highest possible actual rpm value nIST, corresponding to the value pair TVIRT=−20° C. and nIST=2,100 1/min. This value MAX is used to calculate the lower limit value uGW when the lower limit value uGW is not readjusted as a function of the virtual temperature TVIRT and the actual rpm value nIST. The value MAX then represents the second constant K2.

FIG. 4 shows the efficiency map WKF as a table. The values of the actual rpm's are plotted on the x axis in 1/min. The sum torque MSUM is plotted on the y axis in newton-meters. The values in the table correspond to the z values, that is, to the set injection quantity mSL in milligrams per stroke. For example, a set injection quantity of 217 mg/stroke is assigned to the value pair nIST=2,000 1/min and MSUM=3,000 Nm. In the case of negative sum torques MSUM such as −100 Nm, the table has a value zero for the set injection quantity.

Figure 5A:
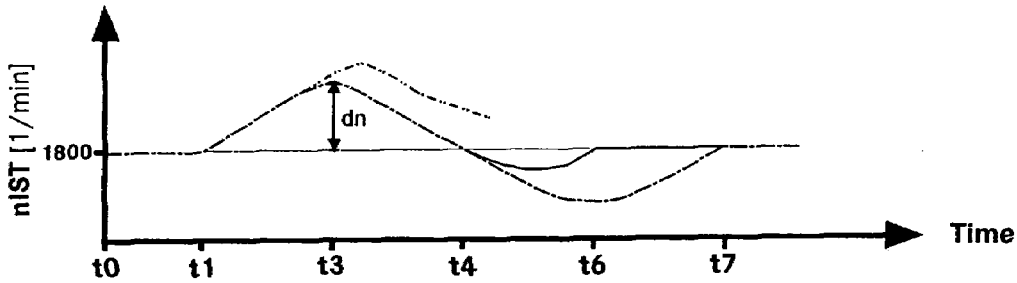
FIGS. 5A-5D show time curves.
Figure 5B:
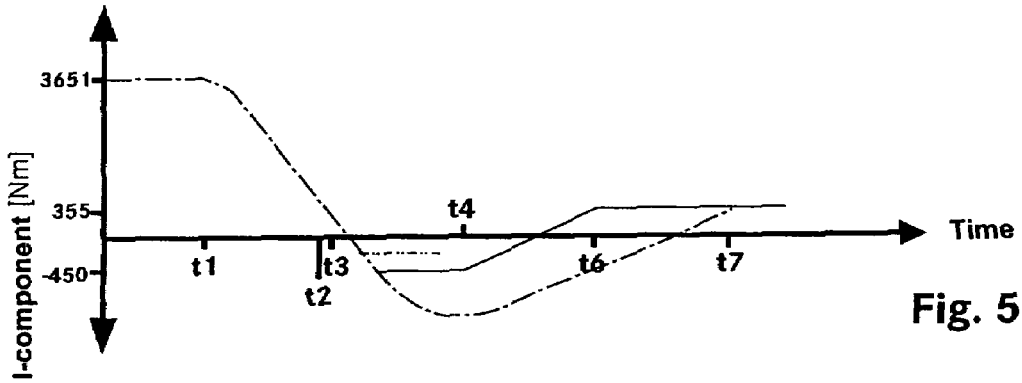
Figure 5C:
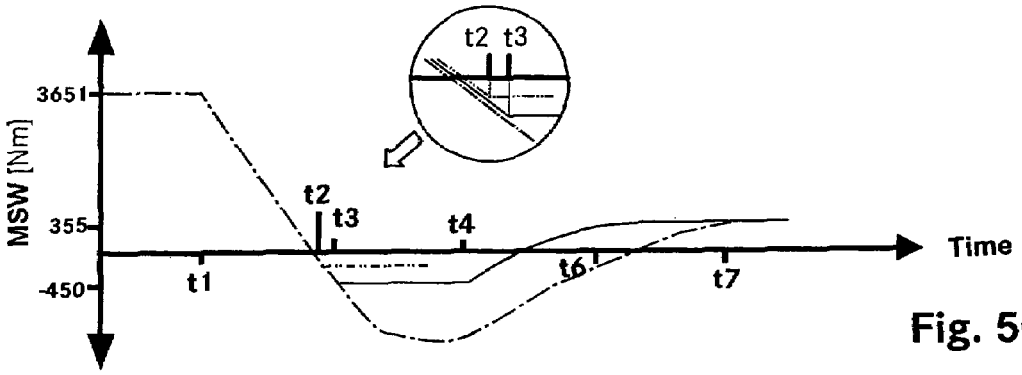
Figure 5D:
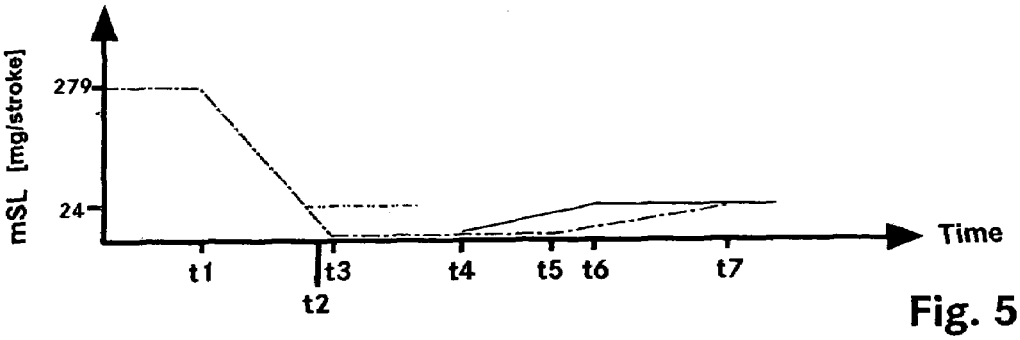

FIGS. 5A-5D show a load-shedding method. Each graph shows the following as a function of time: a curve of the actual rpm value nIST (FIG. 5A), a curve of the I component of the rpm controller (FIG. 5B), a curve of the set torque value MSW (FIG. 5C), and a curve of the set injection quantity mSL (FIG. 5D). Three examples are shown in each of FIGS. 5A-5D. The first example characterizes a curve without limitation of the I component (dash-dot line). The second example characterizes a curve in which the I component is limited too soon (dash-two-dot line). The third example characterizes the curve obtained when the invention is applied (solid line). The time curves shown here were recorded under the following boundary conditions:

TVIRT (full load)=90° C.
TVIRT (no load)=70° C.
M1 (DT1)=0 Nm
MSUM (full load)=4,000 Nm
nSL=constant (1,800 1/min)
At time t0, the internal combustion engine is being operated in a steady state.

The actual rpm value nIST, the I component, the set torque MSW, and the set injection quantity mSL are constant. At time t1, a load shedding occurs in that, for example, in the case of a generator application, the load is significantly reduced on the power takeoff side of the internal combustion engine.

For the first example (dash-dot line), this means the following:

The actual rpm value nIST increases starting at time t1. An increasing actual rpm value nIST causes an increasing negative control deviation e. A negative control deviation e in turn brings about a negative P component and a decreasing I component; that is, starting from the steady-state value of 3,651 Nm, the value of the I component decreases toward the zero line (FIG. 5B). The sum of the P and I components (DT1 component=0) corresponds to the set torque MSW. This also decreases, starting from the steady-state value of 3,651 Nm, toward the zero line (FIG. 5C). Because, at a nearly constant virtual temperature TVIRT, the friction torque MF increases only slightly with an increasing actual rpm value nIST, the course of the set injection quantity mSL follows the course of the set torque MSW (FIG. 5D).

At time t2, the set torque MSW is nearly 0 Nm. Nevertheless, because of the positive friction torque MF such as 350 Nm (FIG. 3: nIST=2,000 1/min, TVIRT=90° C.), a positive set injection quantity mSL of approximately 24 mg/stroke (FIG. 4: nIST=2,000 1/min, MSUM=350 Nm) is calculated at time t2. At time t3, the sum of the set torque MSW and the friction torque MF corresponds to the value −100 Nm, so that a set injection quantity of 0 mg/stroke is calculated. At time t3, the actual rpm value nIST reaches its maximum. In FIG. 5A, the rpm increase is designated "dn". As a result of zero injection, the actual rpm value nIST begins to drop. The set torque value MSW continues to decrease, because the rpm control deviation is negative and thus the I component becomes smaller. At time t4, the control deviation e is zero. The actual rpm value nIST corresponds to the set rpm value nSL of 1,800 1/min. Because the I component and the set torque value MSW are negative and still no fuel is being injected (mSL=0 mg/stroke), the actual rpm value nIST drops below the set rpm value nSL. The now positive control deviation e brings about an increase in the P component, an increase in the I component, and thus an increase in the set torque value MSW toward positive values. An increasing set injection quantity mSL is calculated starting at time t5. At time t7, the actual rpm value nIST corresponds again to the set rpm value nSL, and the underswing is over. For the example shown here, the correction time of the rpm controller after a load shedding corresponds to the period between t1 and t7.

For the second example (dash-two-dot line) in which the I component and the set torque value MSW are limited prematurely, this means:

The signal curves are the same as those of the first example until time t2. Starting at time t2, the set torque value MSW is limited to a negative value, which has a negative value of less than −450 Nm. Because the friction torque MF has a value of 350 Nm, a set injection quantity mSL of greater than zero is calculated by way of the efficiency map. Even though load is being shed, therefore, fuel is still being injected. This has the effect that the actual rpm value nIST increases significantly above the rpm increase dn (FIG. 5A). If the actual rpm value nIST exceeds a limit value, it is possible that the engine could be stopped.

For the third example (solid line), which represents the optimal limitation of the I component, this means:

The signal curves are identical to those of the first and second examples up until time t2. Starting at time t3, the set torque value MSW (see the enlarged detail in FIG. 5C) and then the I component of the rpm controller are limited to the lower limit value uGW. The lower limit value is calculated on the basis of the friction torque MF. The exact calculation can be carried out in accordance with the following relationship:

$$uGW \leqq K1 - MF$$

where:

K1 is the first constant; this corresponds typically to the smallest applied value of the sum torque MSUM in the efficiency map WKF, e.g.., −100 Nm; and MF is the actual friction torque.

In the example presented here, the lower limit value uGW=−450 Nm. The I component of the rpm controller and the set torque value MSW remain limited until the actual rpm value nIST corresponds again to the set rpm value nSL. This is the case at time t4. After that, the I component and thus the set torque MSW, because of the positive control deviation e, start to increase again. At time t6, the control deviation is zero again. The correction time corresponds to the period between t1 and t6.

A comparison of the three examples shows that, as a result of the inventive method, the actual rpm value nIST overshoots less in the positive and negative directions and that the correction time is shorter, because full use is made of the friction of the internal combustion engine to correct the transient.

The absolute friction torque MF was used in the examples described here. In place of the absolute friction torque MF, it is also possible to use the relative friction torque MFr. In this case, the reference to the friction torque MF in the description of FIG. 5 is to be understood as a reference to the relative friction torque MFr.

Figure 6:
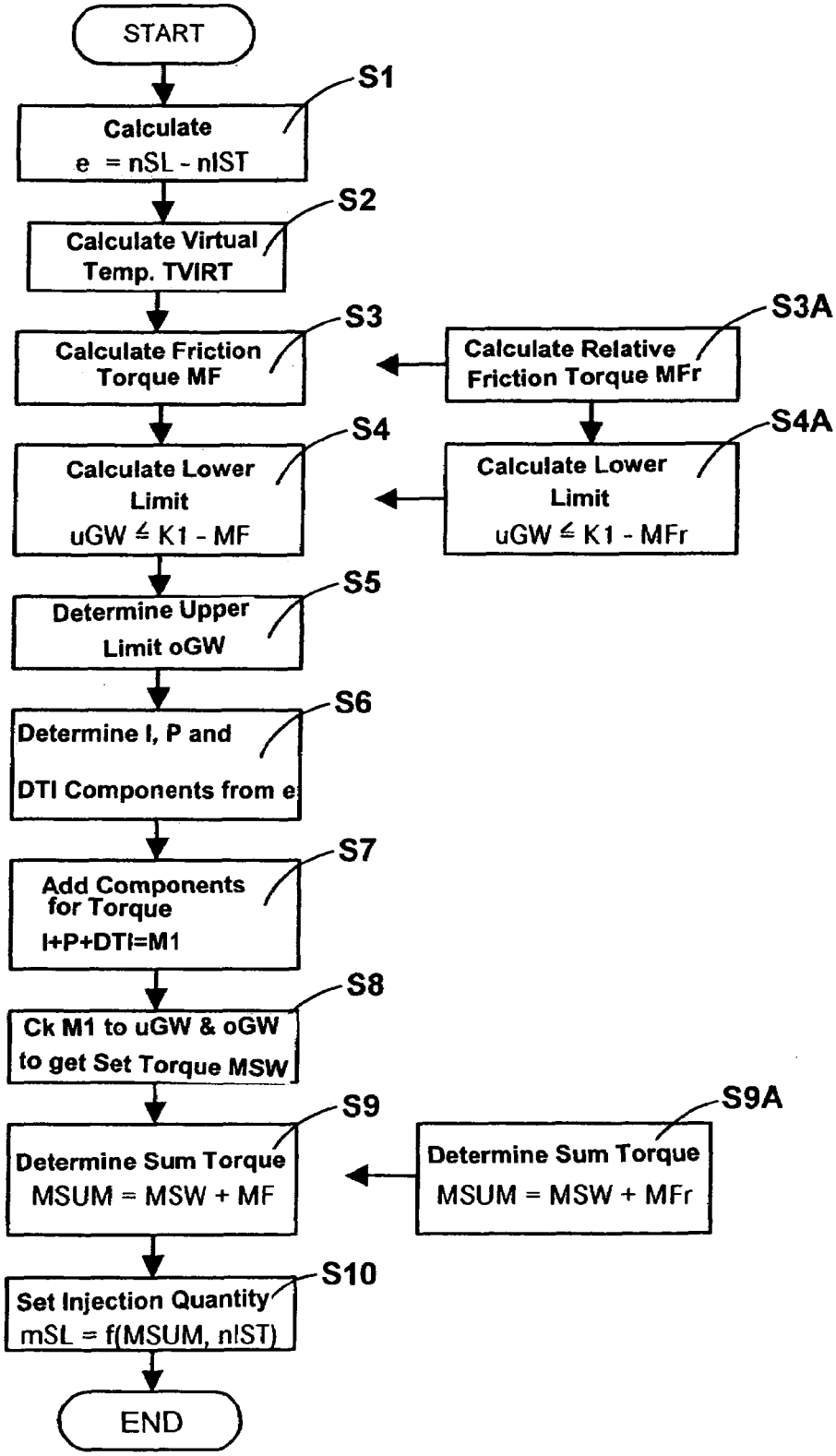
FIG. 6 shows a program flow chart.

FIG. 6 shows a program flow chart. At S1, the actual rpm value nIST and the set rpm value nSL are detected, and the control deviation e is calculated from them. At S2, the virtual temperature TVIRT is calculated by means of a suitable mathematical function from two measured temperatures. At S3, the friction torque MF is calculated by way of the friction torque map RKF as a function of the actual rpm value nIST and the virtual temperature TVIRT; and at S4 the lower limit value uGW is calculated as a function of the friction torque MF. At S5, the upper limit value oGW is determined. Then, at S6, the P component, the I component, and the DT1 component are determined from the control deviation e. At S7, the three controller components are added together. The result corresponds to the torque M1. At S8, the torque M1 is checked against the lower limit value uGW and against the upper limit value oGW. The result corresponds to the set torque MSW. From the set torque MSW and the friction torque MF, the sum torque MSUM is obtained (at S9), and at S10, the set injection quantity mSL is calculated as a function of the sum torque MSUM and the actual rpm value nIST by way of the efficiency map WKF. Thus the program flow is completed.

If, instead of the friction torque MF, the relative friction torque MFr is used, then in FIG. 6 steps S3, S4, and S9 will be replaced by the steps S3A, S4A, and S9A.

The following advantages of the invention can be derived from the preceding description:

- the correction time after load shedding is reduced and the overshoot of the actual rpm value is decreased;
- in a generator application, the legal standards pertaining to load shedding are reliably fulfilled; and
- safety is increased.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A method for torque-oriented control of an internal combustion engine, comprising the steps of: calculating a sum torque (MSUM) from a set torque value (MSW) and a friction torque (MF); calculating a set injection quantity (mSL) for driving the internal combustion engine from the sum torque (MSUM) and an actual rpm value (nIST) using an efficiency map (WKF); calculating the set torque value (MSW) by way of an rpm controller with at least PI behavior from an rpm control deviation (e) between a set rpm value (nSL) and the actual rpm value (nIST); and limiting an I component of the rpm controller to a lower limit value (uGW), which is determined as a function of the friction torque (MF) (uGW=f(MF)).

2. The method according to claim 1, including calculating the lower limit value (uGW) as a function of negative friction torque (MF) and a first constant (K1) (uGW≦K1−MF).

3. The method according to claim 1, including calculating lower limit value (uGW) from the sum of a first constant (K1) and a second constant (K2), which corresponds to a negative maximum friction torque (MAX) of a friction torque map (RKF) (uGW≦K1−MAX).

4. The method according to claim 2, wherein the first constant (K1) corresponds to a support point of the efficiency map (WKF) at which the set injection quantity (mSL) is equal to zero.

5. The method according to claim 3, wherein the first constant (K1) corresponds to a support point of the efficiency map (WKF) at which the set injection quantity (mSL) is equal to zero.

6. The method according to claim 1, wherein the set torque value (MSW) is also limited to the lower limit value (uGW).

7. The method according to claim 1, including calculating the friction torque (MF) as a function of a virtual temperature (TVIRT) and the actual rpm value (nIST) using a friction torque map (RKF).

8. The method according to claim 1, wherein the friction torque (MF) corresponds to a relative friction torque (MFr), which is calculated from the deviation between the actual absolute friction torque (MF) and a standard friction torque (NORM), and the lower limit value (uGW) is calculated as a function of the relative friction torque (MFr) and a first constant (K1) ($uGW \leqq K1 - MF$).

9. The method according to claim 3, wherein the friction torque (MF) corresponds to a relative friction torque (MFr), which is calculated from the deviation between the actual absolute friction torque (MF) and a standard friction torque (NORM), and the lower limit value (uGW) is calculated as a function of the relative friction torque (MFr) and a first constant (K1) ($uGW \leqq K1 - MF$).

10. The method according to claim 8, wherein the first constant (K1) corresponds to a support point of the efficiency map (WKF) at which the set injection quantity (mSL) is equal to zero.

11. The method according to claim 9, wherein the first constant (K1) corresponds to a support point of the efficiency map (WKF) at which the set injection quantity (mSL) is equal to zero.

12. The method according to claim 8, wherein the set torque value (MSW) is also limited to the lower limit value (uGW).

* * * * *